US009204224B2

(12) United States Patent
Hosoe

(10) Patent No.: US 9,204,224 B2
(45) Date of Patent: Dec. 1, 2015

(54) ELECTROSTATIC SPEAKER

(71) Applicant: Yamaha Corporation, Hamamatsu-shi (JP)

(72) Inventor: Seiichiro Hosoe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/362,120

(22) PCT Filed: Nov. 29, 2012

(86) PCT No.: PCT/JP2012/080998
§ 371 (c)(1),
(2) Date: May 30, 2014

(87) PCT Pub. No.: WO2013/081079
PCT Pub. Date: Jun. 6, 2013

(65) Prior Publication Data
US 2014/0321676 A1 Oct. 30, 2014

(30) Foreign Application Priority Data
Nov. 30, 2011 (JP) ..... 2011-262775

(51) Int. Cl.
*H04R 19/00* (2006.01)
*H04R 19/02* (2006.01)

(52) U.S. Cl.
CPC ..... *H04R 19/02* (2013.01)

(58) Field of Classification Search
CPC ..... H04R 7/04; H04R 17/02; H04R 19/04; H04R 19/005; H04R 19/00; H04R 19/01; H04R 19/013; H04R 19/016
USPC ..... 381/191, 173–175, 431
See application file for complete search history.

(56) References Cited

U.S. PATENT DOCUMENTS

| | | | | |
|---|---|---|---|---|
| 5,392,358 | A * | 2/1995 | Driver | 381/191 |
| 8,885,853 | B2 * | 11/2014 | Yamashita et al. | 381/191 |
| 2010/0278363 | A1 | 11/2010 | Yang et al. | |

FOREIGN PATENT DOCUMENTS

| | | | |
|---|---|---|---|
| JP | 07 336797 | A | 12/1995 |
| JP | 2008-118512 | A | 5/2008 |
| JP | 2009-540732 | A | 11/2009 |
| JP | 2010-016603 | A | 1/2010 |
| JP | 2010-021646 | A | 1/2010 |
| JP | 2010-068053 | A | 3/2010 |

OTHER PUBLICATIONS

International Search Report mailed Jan. 8, 2013, for International Application No. PCT/JP2012/080998, with English translation, five pages.

* cited by examiner

*Primary Examiner* — Suhan Ni
(74) *Attorney, Agent, or Firm* — Morrison & Foerster LLP

(57) ABSTRACT

An electrostatic speaker includes: a first electrode formed of a sheet-like member, having a first face including a protrusion and a second face opposite the first face, and having conductivity and flexibility; a second electrode formed of a sheet-like member, disposed so as to be opposed to the second face, and having conductivity and flexibility; and an oscillator formed of a flexible sheet-like member, and disposed between the first electrode and the second electrode, at least one face of which has conductivity.

8 Claims, 4 Drawing Sheets

ELECTROSTATIC SPEAKER

CROSS-REFERENCE TO RELATED APPLICATIONS

This application is a National Phase application under 35 U.S.C. §371 of International Application No. PCT/JP2012/080998 filed Nov. 29, 2012, which claims the priority benefit of Japanese Patent Application No. 2011-262775 filed Nov. 30, 2011, the contents of which are hereby incorporated by reference in their entireties for all intended purposes.

TECHNICAL FIELD

The present invention relates to an electrostatic speaker.

BACKGROUND ART

Electrostatic speakers are attracting attention as speakers capable of generating sound with high straight forwardness by emitting plane waves.

An electrostatic speaker has a structure in which, on each side of a sheet-like oscillator having conductivity, a sheet-like electrode having conductivity is disposed with an insulating spacer held therebetween. The electrode is required to be equipped with numerous through-holes passing through the inside and outside faces thereof and serving as air moving paths so as not to obstruct the oscillation of the oscillator, and the electrode is made of, for example, a cloth woven from conductive fibers or a punching metal sheet.

When a direct-current bias voltage is applied between the oscillator and each of the two electrodes, and an alternate-current voltage drive signal corresponding to a sound waveform is applied between the two electrodes, a drive force corresponding to the drive signal is generated between the oscillator and the electrode in accordance with Coulomb's law, and the oscillator oscillating between the two electrodes by virtue of the drive force generates sound pressure. As a result, sound corresponding to the sound waveform is emitted.

In order that the electrostatic speaker having the above-mentioned structure reproduces sound with a large volume, a high voltage is required to be applied between the oscillator and the electrode; however, if the applied voltage is too high, discharge, such as arc discharge, occurs between the oscillator and the electrode, or the oscillator and the electrode make contact with each other via the through-holes in the spacer disposed therebetween, whereby leakage may occur in some cases.

If discharge and leakage occur between the oscillator and the electrode, explosive sound is superimposed on reproduced sound as noise, and the oscillator and electrode are broken, whereby deterioration in the sound reproduction performance of the electrostatic speaker occurs.

For the purpose of solving the above-mentioned problems, it is considered that, for example, the surface of the electrode is subjected to an insulation treatment; however, this method generally increases cost.

Hence, for example, in Patent Document 1, an electrostatic speaker has been proposed in which a capacitor element is disposed in series between the electrode and the supply source of the drive signal, thereby suppressing the occurrence of discharge or the like at lower cost than that of the treatment for insulating the surface of the electrode.

Furthermore, for example, in Patent Document 2, an electrostatic speaker has been proposed in which a sheet-like water repellent member having water repellency is disposed on the outside of each of the two electrodes thereof, and a surface member provided with numerous small-diameter through-holes is disposed further outside each of the water repellent members, whereby liquid and solid are hard to enter the inside.

With the electrostatic speaker proposed in Patent Document 2, moisture and dust are hard to enter the inside, whereby the induction of discharge and leakage due to moisture and dust is reduced.

PRIOR ART DOCUMENT

Patent Document

Patent Document 1: JP-A-7-336797
Patent Document 2: JP-A-2010-068053

GENERAL DESCRIPTION OF THE INVENTION

Problem that the Invention is to Solve

In comparison with, for example, dynamic speakers having been widely spread, electrostatic speakers have a structure in which the thickness thereof is made small easily. A foldable or rollable sheet-like speaker can also be produced, for example, by forming all of the oscillator, the spacers and the electrodes thereof using thin flexible sheets.

A sheet-like speaker can be used, for example, as an advertisement medium appealing audio-visually by printing an advertisement image on the surface member thereof that is disposed on the outside of the electrodes to protect the oscillator and the electrodes from the outside and by guiding an advertisement content by voice. In such a use, the speaker itself is required to be replaced in order that an advertisement, the effect of which has lowered, is replaced. Hence, a sheet-like electrostatic speaker that is particularly used for such a use is required to be low in cost.

On the other hand, in the case that the thickness of the electrostatic speaker is made thin, the gap between the electrode and the oscillator becomes thin inevitably. As a result, discharge and leakage are liable to occur between the electrode and the oscillator.

The present invention has been made under the above-mentioned background and it is an object of the present invention to provide means for reducing discharge and leakage between the electrode and the oscillator of an electrostatic speaker at low cost.

Means for solving the Problem

For the purpose of solving the above-mentioned problems, the present invention provides an electrostatic speaker comprising: a first electrode formed of a sheet-like member, having a first face including a protrusion and a second face opposite the first face, and having conductivity and flexibility; a second electrode formed of a sheet-like member, disposed so as to be opposed to the second face, and having conductivity and flexibility; and an oscillator formed of a flexible sheet-like member, and disposed between the first electrode and the second electrode, at least one face of which has conductivity.

Conductivity of the second face may be lower than conductivity of the first face.

The second face may include a protrusion, and the protrusion of the first face may be larger than the protrusion of the second face.

The first face may include a plurality of protrusions and the second face may include a plurality of protrusions, and an average height value of the plurality of protrusions of the first face may be larger than an average height value of the plurality of protrusions of the second face.

Both faces of the oscillator may have conductivity, and the second electrode may have a third face including a protrusion and a fourth face opposite the third face, and the fourth face may be opposed to the oscillator.

Conductivity of the fourth face may be lower than conductivity of the third face.

The fourth face may include a protrusion, and the protrusion of the third face may be larger than the protrusion of the fourth face.

The third face may include a plurality of protrusions and the fourth face may include a plurality of protrusions, and an average height value of the plurality of protrusions of the third face may be larger than an average height value of the plurality of protrusions of the fourth face.

Advantage of the Invention

With the present invention, even in the case that an electrode produced using, for example, a low-cost production method and having numerous protrusions on one face is used, the occurrence of discharge and leakage between the electrode and the oscillator can be reduced without requiring an insulation treatment or the like for the electrode.

MODE FOR CARRYING OUT THE INVENTION

Embodiment

Figure 1:
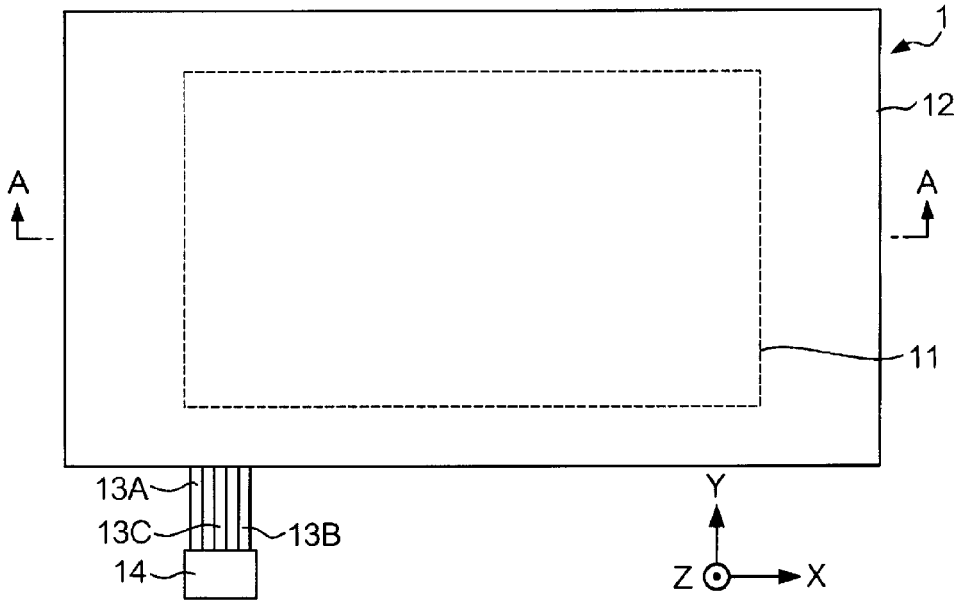
FIG. 1 is a top view showing an electrostatic speaker according to an embodiment of the present invention.
Figure 2:
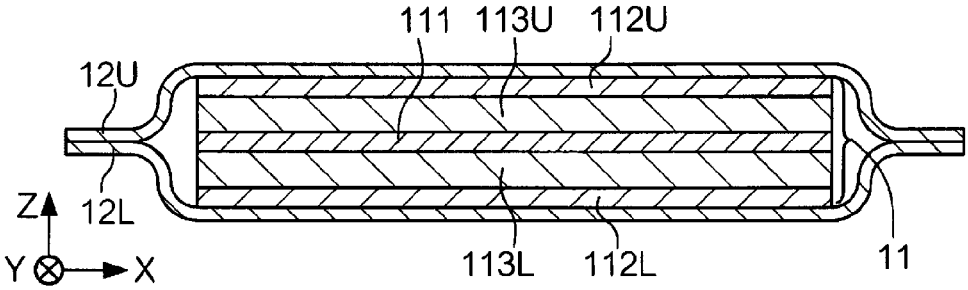
FIG. 2 is a cross-sectional view showing the electrostatic speaker according to the embodiment of the present invention.

FIG. 1 is a top view showing an electrostatic speaker 1 according to an embodiment of the present invention, and FIG. 2 is a cross-sectional view taken on line A-A of FIG. 2.

In FIGS. 1 and 2, directions are indicated by X, Y and Z axes being orthogonal to one another; when the cross-section of the electrostatic speaker 1 shown in FIG. 2 is viewed from the front, the left-right direction is set as the X axis, the depth direction is set as the Y axis, and the height direction is set as the Z axis. Furthermore, it is assumed that the sign in the drawing, indicated by "•" placed in "○", denotes an arrow directed from the back to the front of the drawing. Moreover, it is assumed that the sign in the drawing, indicated by "x" placed in "○", denotes an arrow directed from the front to the back of the drawing.

Besides, the dimensions of the respective members shown in the drawing are made different from their actual dimensions so that the shapes and positional relationships of the respective members can be understood easily; in particular, the lengths in the height direction (the direction of the Z axis) are shown longer than their actual lengths.

As shown in FIGS. 1 and 2, the electrostatic speaker 1 is equipped with a sound emitting part 11 that is driven by voltage applied from a drive circuit 2 (described later) to emit sound; covers 12 for accommodating the sound emitting part 11; three cables 13 (a cable 13A, a cable 13B and a cable 13C) serving as lead wires for electrically connecting the drive circuit 2 to the sound emitting part 11; and a connector 14 that is engaged with a connector 24 (described later) provided for the drive circuit 2 to establish an electrical connection between the cables 13 and the drive circuit 2.

The sound emitting part 11 is equipped with an oscillator 111; an electrode 112U and an electrode 112L disposed above and below the oscillator 111, respectively; and an elastic member 113U and an elastic member 113L disposed between the oscillator 111 and the electrode 112U and between the oscillator 111 and the electrode 112L, respectively. In other words, the electrode 112U is disposed so as to be separated from the oscillator 111 by the elastic member 113U, and the electrode 112L is disposed so as to be separated from the oscillator 111 by the elastic member 113L.

As in the electrode 112U and the electrode 112L, it is indicated that members having the same number (or number+ lowercase alphabet letter) to which "U" or "L" is added are members having the same configuration, and that the member with "U" is the member disposed on the upper side in FIG. 1 and the member with "L" is the member disposed on the lower side in FIG. 1. In addition, in the case that it is not necessary to distinguish the member with "U" from the member with "L", the member is simply written as, for example, "electrode 112", by omitting "L" and "U".

In the members constituting the sound emitting part 11, that is, the members laminated in the order of the electrode 112L, the elastic member 113L, the oscillator 111, the elastic member 113U and the electrode 112U from the lower side to the upper side in FIG. 2, members making contact with each other are bonded to each other using, for example, an adhesive around the whole peripheries of their outer edge portions, that is, in belt-like regions having a predetermined width from their outer-edge end portions in the X-axis direction and in regions having a predetermined width from their outer-edge end portions in the Y-axis direction.

The oscillator 111 is a sheet-like member on which a conductive layer is formed by evaporating conductive metal, such as aluminum, on one face of a synthetic resin film (insulation layer) having insulation property and flexibility and made of, for example, PET (polyethylene terephthalate) or PP (polypropylene). The upper face of the oscillator 111 in FIG. 2 is the face on which the conductive layer is formed.

Like the oscillator 111, the electrode 112 is a sheet-like member on which a conductive layer is formed by evaporating conductive metal, such as aluminum, on one face of a synthetic resin film (insulation layer) having insulation property and made of, for example, PET or PP. With respect to the electrode 112U, the upper face of the electrode 112U in FIG. 2 is the face on which the conductive layer is formed; with respect to the electrode 112L, the lower face of the electrode 112L in FIG. 2 is the face on which the conductive layer is formed.

Unlike the oscillator 111, the electrode 112 is provided with numerous through-holes 112*h* passing through the front and back faces thereof. However, the through-holes 112*h* are not shown in FIG. 2. These through-holes 112*h* function as paths through which air moves mainly in the Z-axis direction in accordance with the oscillation of the oscillator 111. The through-holes 112*h* may be perforated after the evaporation of the metal on the synthetic resin film constituting the electrode 112 or may be perforated in the synthetic resin film before the evaporation of the metal.

The through-holes 112*h* are formed by subjecting a synthetic resin film constituting the insulation layer of the electrode 112 to a perforating process using a heated needle method, a hole melting method or the like. In the perforating process using the heated needle method, generally, heated needles are pressed against a synthetic resin film to melt and perforate the synthetic resin. Furthermore, in the perforating process using the hole melting method, generally, metal particles or the like melted by, for example, arc melting are projected onto a synthetic resin film to melt and perforate the synthetic resin. In any of these perforating processes, generally, the synthetic resin melted and extruded at the time of the perforation is cooled and solidified, and protruding portions are formed on at least one side face of the synthetic resin film after the perforating process.

Figure 3:
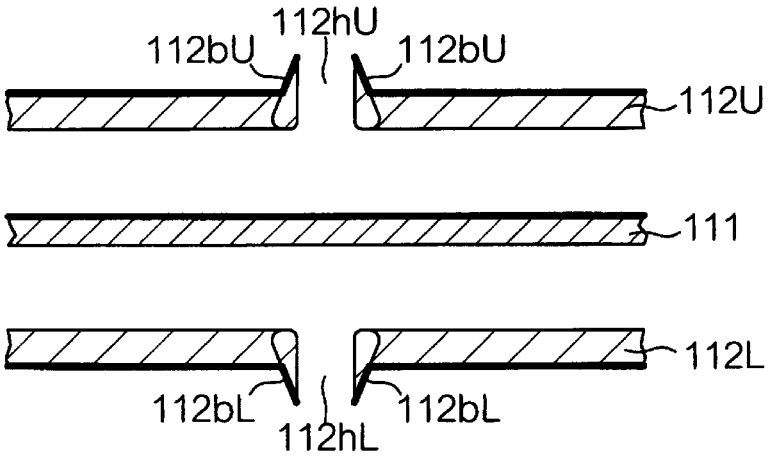
FIG. 3 is a magnified view showing an area around a through-hole provided in the electrode of the electrostatic speaker according to the embodiment of the present invention.

FIG. 3 is a magnified view showing an area around the through-hole 112*h* provided in the electrode 112U and 112L. In FIG. 3, the oscillator 111 is shown to indicate the positional relationship among the electrode 112U, the electrode 112L and the oscillator 111, but other members, such as the elastic members 113, are not shown.

As shown in FIG. 3, a protruding portion 112*b*U is formed on the edge portion of the through-hole 112*h*U provided in the electrode 112U. In the electrostatic speaker 1, the protruding portion 112*b*U is disposed on the face of the electrode 112U on the side not opposed to the oscillator 111. The protruding portion 112*b*U is provided with a conductive layer indicated by a thick line in FIG. 3. In other words, the conductive layer also protrudes accompanied by the protrusion of the protruding portion 112*b*U. However, since the direction of the protrusion of the conductive layer is oriented in a direction opposite to the direction toward the oscillator 111, the induction of discharge and leakage due to the protruding portion 112*b*U does not occur between the oscillator 111 and the electrode 112U.

Furthermore, as shown in FIG. 3, a protruding portion 112*b*L is formed on the edge portion of the through-hole 112*h*L provided in the electrode 112L. In the electrostatic speaker 1, the protruding portion 112*b*L is disposed on the face of the electrode 112L on the side not opposed to the oscillator 111. The protruding portion 112*b*L is provided with a conductive layer indicated by a thick line in FIG. 3. In other words, the conductive layer also protrudes accompanied by the protrusion of the protruding portion 112*b*L. However, since the direction of the protrusion of the conductive layer is oriented in a direction opposite to the direction toward the oscillator 111, the induction of discharge and leakage due to the protruding portion 112*b*L does not occur between the oscillator 111 and the protruding portion 112*b*L.

Referring to FIG. 2 again, the description of the members constituting the electrostatic speaker 1 will be continued. The elastic member 113 is a sheet-like nonwoven cloth having insulation property and is configured so that air can move between one face and the other face thereof via voids formed among the numerous fibers thereof extending in indefinite directions. In addition, the elastic member 113 has elasticity, thereby being deformed when a force is applied from the oscillator 111 in accordance with the oscillation of the oscillator 111 and returning to its original shape when the force is removed.

The covers 12 is a synthetic resin sheet made of polyethylene or the like and having insulation property and moisture proofness, and the lengths thereof in the X-axis direction and the Y-axis direction are longer than the lengths of the sound emitting part 11. The cover 12U and the cover 12L constituting the cover 12 cover the sound emitting part 11 from the upper and lower sides, and the outer edge portions thereof laminated on the sides of the sound emitting part 11 are bonded to each other around the whole periphery thereof using, for example, an adhesive. As a result, the cover 12 formed into a bag shape has a structure for hermetically accommodating the sound emitting part 11.

Figure 4:
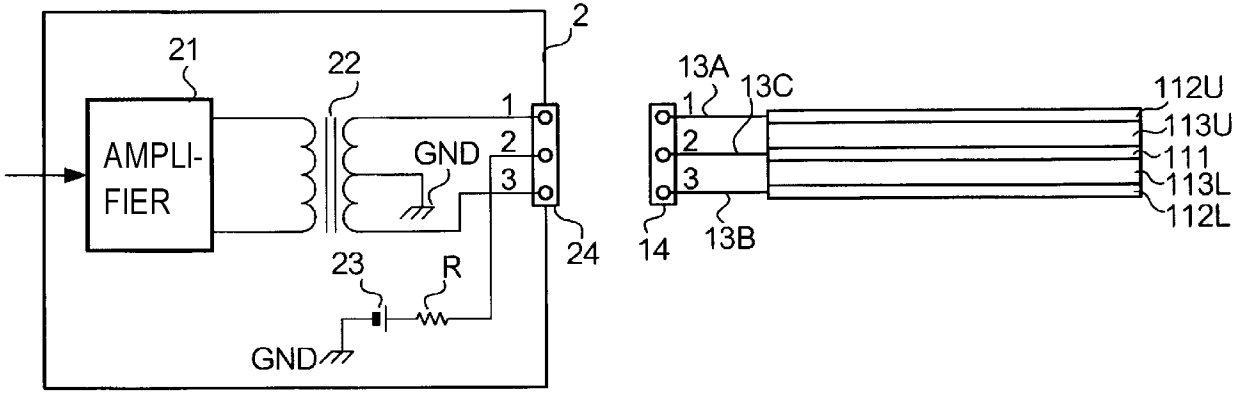
FIG. 4 is a view showing a drive circuit for driving the electrostatic speaker according to the embodiment of the present invention and showing the members for receiving voltages applied from the drive circuit in the members of the electrostatic speaker according to the embodiment of the present invention.

As described above, the electrostatic speaker 1 is equipped with the cable 13A, the cable 13B, the cable 13C and the connector 14 as members for receiving voltages applied from the drive circuit 2 to the sound emitting part 11. FIG. 4 is a view showing the drive circuit 2 for driving the electrostatic speaker 1 and showing the members for receiving voltages applied from the drive circuit 2 in the members of the electrostatic speaker 1.

As shown in FIG. 4, one end of the cable 13A is connected to the conductive layer of the electrode 112U accommodated in the cover 12, one end of the cable 13B is connected to the conductive layer of the electrode 112L accommodated in the cover 12, and one end of the cable 13C is connected to the conductive layer of the oscillator 111 accommodated in the cover 12. Furthermore, the other ends of the cable 13A, the cable 13B and the cable 13C are connected to the number 1 terminal, the number 3 terminal and the number 2 terminal of the connector 14, respectively.

As shown in FIG. 4, the drive circuit 2 is equipped with an amplifier 21, a transformer 22, a bias power source 23 and a connector 24.

The amplifier 21 is an apparatus for amplifying an alternate-current acoustic signal input from the outside and outputting the amplified signal, the output terminals of which are connected across the primary coil of the transformer 22. In other words, the alternate-current acoustic signal amplified by the amplifier 21 is supplied to the transformer 22.

The center tap of the secondary coil of the transformer 22 is connected to the ground GND of the drive circuit 2. Furthermore, one terminal of the secondary coil of the transformer 22 is connected to the number 1 terminal of the connector 24, and the other terminal thereof is connected to the number 3 terminal of the connector 24.

The bias power source 23 is a power source for applying a direct-current plus bias voltage to the oscillator 111, the minus side of which is connected to the ground GND of the drive circuit 2 and the plus side of which is connected to the number 2 terminal of the connector 24 via a resistor R serving as a protection resistor.

The connector 24 is engaged with the connector 14 of the electrostatic speaker 1, thereby establishing electrical connection between the drive circuit 2 and the electrostatic speaker 1. As described above, the one terminal of the transformer 22 is connected to the number 1 terminal of the connector 24, the other terminal of the transformer 22 is connected to the number 3 terminal thereof, and the bias power source 23 is connected to the number 2 terminal thereof via the resistor R.

When the connector 14 of the electrostatic speaker 1 and the connector 24 of the drive circuit 2 are engaged with each other, the terminals of the respective connectors, having the same number, are electrically connected to each other. As a result, the one terminal of the transformer 22 is connected to the conductive layer of the electrode 112U, the other terminal of the transformer 22 is connected to the conductive layer of the electrode 112L, and the bias power source 23 is connected to the conductive layer of the oscillator 111.

When the connector 14 and the connector 24 are engaged, a bias voltage, that is, a predetermined direct-current plus voltage, is applied to the oscillator 111. In a state in which no acoustic signal is input to the drive circuit 2 from the outside, the voltage applied between the electrode 112U and the electrode 112L is 0 V.

When an alternate-current acoustic signal is input to the drive circuit 2, the input acoustic signal is amplified by the amplifier 21, supplied to the primary side of the transformer 22, stepped up in voltage by the transformer 22, and supplied to the electrode 112U and the electrode 112L. At the time, the acoustic signal supplied to the electrode 112U and the acoustic signal supplied to the electrode 112L are equal in amplitude but opposite in polarity.

In other words, when a plus acoustic signal is input to the amplifier 21, a plus voltage is applied to the electrode 112U, and a minus voltage having the same amplitude as that of the plus voltage is applied to the electrode 112L. In that case, the electrostatic attractive force between the oscillator 111 and the electrode 112U becomes weak, but the electrostatic attractive force between the oscillator 111 and the electrode 112L becomes strong. As a result, the oscillator 111 is displaced to the side of the electrode 112L (in the Z-axis negative direction) depending on the difference between the electrostatic attractive forces.

Furthermore, when a minus acoustic signal is input to the amplifier 21, a minus voltage is applied to the electrode 112U, and a plus voltage having the same amplitude as that of the minus voltage is applied to the electrode 112L. In that case, the electrostatic attractive force between the oscillator 111 and the electrode 112L becomes weak, but the electrostatic attractive force between the oscillator 111 and the electrode 112U becomes strong. As a result, the oscillator 111 is displaced to the side of the electrode 112U (in the Z-axis positive direction) depending on the difference between the electrostatic attractive forces.

As described above, the oscillator 111 is displaced repeatedly in the Z-axis positive and negative directions in accordance with the acoustic signal to be input to the amplifier 21 and thereby oscillates, whereby a sound wave in accordance with the oscillation state thereof (frequency, amplitude and phase) is emitted as sound from the oscillator 111.

The above description applies to the configurations and the operations of the electrostatic speaker 1 according to the embodiment of the present invention and the drive circuit 2 for driving the electrostatic speaker 1.

As described above, in the electrostatic speaker 1, a material obtained by performing metal evaporation on one face of a synthetic resin sheet having insulation property and then by subjected the sheet to the perforating process using the heated needle method, the hole melting method or the like (or a material obtained by subjecting a synthetic resin sheet having insulation property to the perforating process using the heated needle method, the hole melting method or the like and then by evaporating metal on one face thereof) is used for the electrode 112U and the electrode 112L. The material adopted for the electrode 112U and the electrode 112L can be formed to be thin and lightweight and is generally low in cost, in comparison with materials, such as a cloth woven from conductive fibers, a wire net and a punching metal, having been adopted widely for the electrodes of electrostatic speakers according to conventional techniques.

However, in many of low-cost perforating processes, such as the heated needle method, protruding portions are formed on one face of the synthetic resin sheet but not on the other face. These protruding portions are accompanied by the protrusion of the evaporated metal, whereby, when a voltage in accordance with an acoustic signal is applied to the electrode 112, discharge and leakage may be induced between the oscillator 111 and the electrode 112. This problem does not occur in the case of the materials having been adopted widely for the electrodes of the electrostatic speakers according to conventional techniques.

To solve this problem, a method that can be easily arrived at is a method in which the protruding portions are removed by performing a treatment, such as cutting or grinding. However, such a treatment raises the cost of the electrode 112. Therefore, the inventors of the present application conceived the idea of configuring the electrostatic speaker 1 in which the protruding portions are purposefully left and, at the same time, the protruding direction of the protruding portions is oriented on the side not opposed to the oscillator 111. With the electrostatic speaker 1 configured according to the idea, the problem of discharge and leakage that may be induced due to the protruding portions is avoided effectively without impairing the low-cost property of the newly adopted electrode 112.

Modification

Although the embodiment according to the present invention has been described above, the present invention is not limited to the above-mentioned embodiment, but can be embodied with other various embodiments. For example, the above-mentioned embodiment may be modified as described below to embody the present invention. The above-mentioned embodiment and the following modifications may be combined variously to the extent that no contradiction occurs.

(Disposition Relationship Between the Conductive Layer and the Protruding Portion)

In the above-mentioned embodiment, as the disposition relationship between the conductive layer of the oscillator 111 and the conductive layers and the protruding portions 112*b* of the electrodes 112 in the electrostatic speaker 1, the disposition relationship shown in FIG. 3 is adopted. The present invention is not limited to this respect, and other various disposition relationships can be adopted.

Figure 5A:
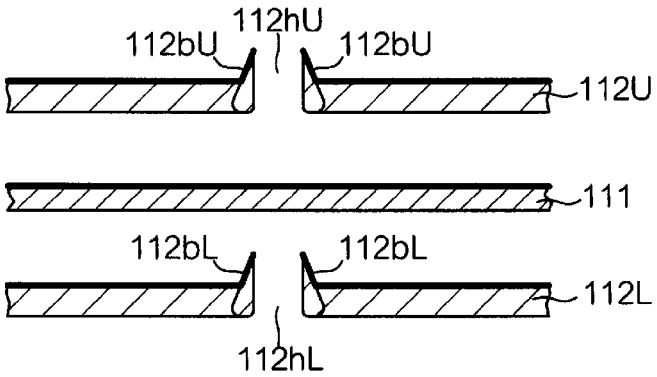
FIGS. 5(*a*), 5(*b*) and 5(*c*) are views showing the disposition relationship between the conductive layer of an oscillator and the conductive layers and the protruding portions of electrodes according to modifications of the present invention.
Figure 5B:
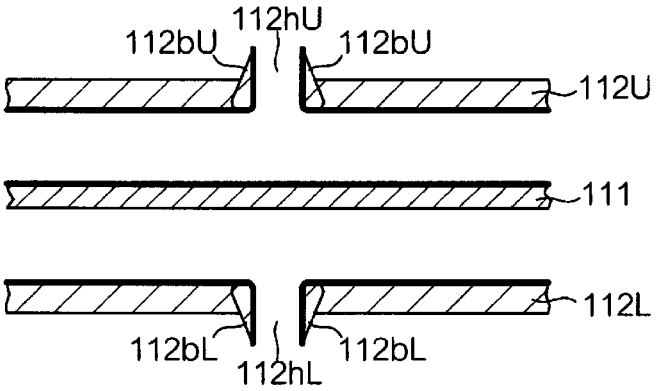
Figure 5C:
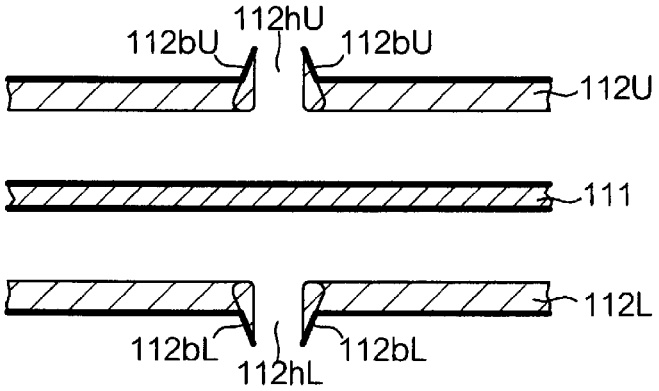

FIG. 5 is a view showing other examples of the disposition relationship between the conductive layer of the oscillator 111 and the conductive layers and the protruding portions 112*b* of the electrodes 112 that can be adopted in the present invention.

In the example shown in FIG. 5(*a*), the face of the electrode 112L on the side opposed to the oscillator 111 is reversed in comparison with the example shown in FIG. 3. In other words, the conductive layer and the protruding portion 112*b*L of the electrode 112L are disposed on the side opposed to the oscillator 111. Since the face of the oscillator 111 on the side opposed to the electrode 112L is formed of an insulation layer of synthetic resin, even in the case that the protruding portion 112*b*L protrudes toward the oscillator 111 and, accompanied by this protrusion, part of the conductive layer of the electrode 112L protrudes toward the oscillator 111, discharge and leakage do not occur between the oscillator 111 and the electrode 112L unless a very high voltage is applied between the oscillator 111 and the electrode 112L. As a result, also in the example shown in FIG. 5(*a*), the electrostatic speaker 1 being low in cost and hard to cause discharge and leakage is realized.

In the example shown in FIG. 5(*b*), in the electrode 112U and the electrode 112L, although each of the protruding portion 112*b*U and the protruding portion 112*b*L is disposed on the face on the side not opposed to the oscillator 111 as in the example shown in FIG. 3, each of the conductive layers is disposed on the side opposed to the oscillator 111, unlike in the example shown in FIG. 3.

Furthermore, in the example shown in FIG. 5(*b*), in the production of the electrode 112U and the electrode 112L, metal evaporation is performed on a synthetic resin sheet having insulation property and then a perforation treatment is performed in the direction from the face on the side on which the metal evaporation has been performed to the side on which the metal evaporation is not performed; as a result, part of each of the conductive layers protrudes toward the back face side via the through-hole 112*h*, that is, toward the side not opposed to the oscillator 111.

In the example shown in FIG. 5(*b*), since the distance between the conductive layer of the oscillator 111 and the conductive layer of the electrode 112U is small in comparison with the example shown in FIG. 3, discharge or leakage is more liable to occur than in the example shown in FIG. 3; however, since the protrusion of the conductive layers accompanied by the protrusion of the protruding portion 112*b*U and the protruding portion 112*b*L is not directed toward the oscillator 111, discharge and leakage due to the protrusion thereof do not occur. As a result, also in the example shown in FIG. 5(*b*), the electrostatic speaker 1 being low in cost and hard to cause discharge and leakage is realized, provided that the insulation property between the oscillator 111 and the electrode 112U is securely obtained using the elastic member 113U.

In the example shown in FIG. 5(*c*), a conductive layer is provided on the face of each side of the oscillator 111. In other words, metal evaporation is performed not only on the face of the oscillator 111 on the side opposed to the electrode 112U but also on the face thereof on the side opposed to the electrode 112L, whereby conductive layers are formed on both faces. In the case that the conductive layers are provided on both faces of the oscillator 111 as described above, the symmetry of the sound emitting part 11 in the Z-axis direction is enhanced, and sound with more desirable acoustic characteristics can be emitted in some cases.

Since the conductive layer is provided on the face of the oscillator 111 on the side opposed to the electrode 112L, discharge or leakage between the oscillator 111 and the electrode 112L due to the protrusion of the conductive layer of the electrode 112L accompanied by the protrusion of the protruding portion 112*b*L of the electrode 112L may occur unlike in the example shown in FIG. 5(*a*); however, since the protruding portion 112*b*L of the electrode 112L is disposed so as to protrude toward the side not opposed to the oscillator 111 in the example shown in FIG. 5(*c*), discharge or leakage does not occur. As a result, also in the example shown in FIG. 5(*c*), the electrostatic speaker 1 being low in cost and hard to cause discharge and leakage is realized.

(Material of the Electrode)

In the above-mentioned embodiment, the material obtained by performing metal evaporation on one face of a synthetic resin sheet having insulation property, the synthetic resin sheet being subjected to a perforating process before or after the metal evaporation, is used for the electrode 112U and the electrode 112L. The present invention is not limited to this respect, and any other materials may be adopted as the material of the electrode 112, provided that the material is a conductive sheet-like material provided with numerous through-holes having protrusions on one face thereof, the average height of the protrusions being larger than that on the other face.

For example, a material obtained by subjecting a conductive sheet, such as aluminum foil, to a perforating process in which needle pressing or hole melting is performed for the sheet may be adopted for the electrode 112. Even in that case, although protrusions on one face, the average height of which is larger than that on the other face, are formed in the case that numerous low-cost perforating processes are used, the induction of discharge and leakage due to the protruding portions is reduced by disposing the face on the side having the high protrusions on the side not opposed to the oscillator 111.

(Type of Protrusions)

In the above-mentioned embodiment, it has been assumed that the protruding portion 112*b* is formed when the perforating process is performed for the electrode 112; however, the present invention is not limited to this respect, and as the reason that the protruding portion 112*b* is formed on the electrode 112, any reasons may be used.

For example, in the case that the electrode 112 is rolled before or after the production of the electrostatic speaker 1, wrinkles are formed on the face on the side that becomes the inside when the electrode 112 is rolled. Such wrinkles formed as described above are also protruding portions according to the present invention, and in the case that the electrostatic speaker 1 is configured so that the wrinkles are disposed on the side not opposed to the oscillator 111, the induction of discharge and leakage due to the wrinkles is reduced.

More specifically, for example, in the case that the oscillator 111, the electrode 112U and the electrode 112L are disposed as in the example shown in FIG. 3, and in the case that a configuration is made so that rolling is performed such that the upper side in the figure becomes the inside, protruding portions due to wrinkles are formed on the upper side face of the electrode 112U in FIG. 3; however, since the direction of the production is oriented toward the side not opposed to the oscillator 111, discharge and leakage are not induced. In that case, protruding portions due to wrinkles are also formed on the upper side face of the electrode 112L and the direction of the production is oriented toward the side opposed to the oscillator 111; however, since the side of the oscillator 111 opposed to the electrode 112L is provided with an insulation layer, discharge and leakage are not induced by the protruding portions protruding from the electrode 112L to the oscillator 111, as in the example shown in FIG. 5(*a*).

Furthermore, in the above-mentioned embodiment, the protruding portions 112*b* are formed only on one side face of the electrode 112; however, the protruding portions may be formed on both sides of the electrode 112 in some cases depending on the method for forming the through-holes 112*h* in the electrode 112. In such a case, in the electrostatic speaker according to the present invention, the face on the side in which the average protrusion height value of the protrusion portions is larger is disposed so as to become the side not opposed to oscillator 111. As a result, discharge and leakage are not induced improperly by the protruding portions.

(Method for Forming the Conductive Layer)

Although the metal evaporation has been adopted as a method for forming conductive layers on the oscillator 111 and the electrode 112 in the above-mentioned embodiment, the present invention is not limited to this respect. For example, a method for applying a conductive paint to a synthetic resin sheet having insulation property may be adopted, or a metal sheet produced by rolling, such as an aluminum foil, may also be used as the material of the oscillator 111 or the electrode 112.

(Other Modifications)

Some modifications mainly relating to the configurations of the electrode 112 and the oscillator 111 have been described above; however, also with respect to the other constituent members of the electrostatic speaker 1, various configurations different from those adopted in the above-mentioned embodiment can be adopted for the electrostatic speaker 1 according to the present invention. For example, the material of the elastic member 113 is not limited to a nonwoven cloth but any other materials having insulation property, air permeability and elasticity may be adopted for the elastic member 113. Moreover, the material of the cover 12 is not limited to polyethylene, but any other materials having insulation property, moisture proofness and flexibility may be adopted for the cover 12.

Although the present invention has been described in detail referring to the specific embodiment, it is obvious to those skilled in the art that various changes and modifications can be made without departing from the spirit and scope of the present invention.

This application is based on Japanese Patent Application (JP2011-262775) filed on Nov. 30, 2011, the contents of which are hereby incorporated by reference.

INDUSTRIAL APPLICABILITY

With the present invention, an electrostatic speaker capable of reducing discharge and leakage between the electrode and the oscillator thereof can be realized at low cost.

DESCRIPTION OF REFERENCE NUMERALS AND SIGNS

1 . . . electrostatic speaker, 2 . . . drive circuit, 11 . . . sound emitting part, 12 . . . cover, 13 . . . cable, 14 . . . connector, 21 . . . amplifier, 22 . . . transformer, 23 . . . bias power source, 24 . . . connector, 111 . . . oscillator, 112 . . . electrode, 113 . . . elastic member

The invention claimed is:

1. An electrostatic speaker comprising:

a first electrode formed of a sheet-like member, having a first face including a plurality of protrusions and a second face opposite the first face, and having conductivity and flexibility, the plurality of protrusions each having a through hole passing through the first face and the second face of the first electrode;

a second electrode formed of a sheet-like member, disposed so as to be opposed to the second face, and having conductivity and flexibility; and an oscillator formed of a flexible sheet-like member, and disposed between the first electrode and the second electrode, at least one face of which has conductivity.

2. The electrostatic speaker according to claim 1, wherein conductivity of the second face is lower than conductivity of the first face.

3. The electrostatic speaker according to claim 1, wherein the second face includes a protrusion, and at least one of the plurality of protrusions of the first face is larger than the protrusion of the second face.

4. The electrostatic speaker according to claim 3 wherein the second face includes a plurality of protrusions, and an average height value of the plurality of protrusions of the first face is larger than an average height value of the plurality of protrusions of the second face.

5. The electrostatic speaker according to claim 1, wherein both faces of the oscillator has conductivity, and the second electrode has a third face including a protrusion and a fourth face opposite the third face, and the fourth face is opposed to the oscillator.

6. The electrostatic speaker according to claim 5, wherein conductivity of the fourth face is lower than conductivity of the third face.

7. The electrostatic speaker according to claim 5, wherein the fourth face includes a protrusion, and the protrusion of the third face is larger than the protrusion of the fourth face.

8. The electrostatic speaker according to claim 7, wherein the third face includes a plurality of protrusions and the fourth face includes a plurality of protrusions, and an average height value of the plurality of protrusions of the third face is larger than an average height value of the plurality of protrusions of the fourth face.

* * * * *